US006860256B2

(12) United States Patent
Nakamura et al.

(10) Patent No.: US 6,860,256 B2
(45) Date of Patent: Mar. 1, 2005

(54) IGNITION APPARATUS FOR INTERNAL COMBUSTION ENGINE

(75) Inventors: Kazuhiro Nakamura, Osaka (JP); Timothy Sieczka, Osaka (JP); Timothy Goodrich, Osaka (JP)

(73) Assignee: Diamond Electric Mfg. Co., Ltd., Osaka (JP)

( * ) Notice: Subject to any disclaimer, the term of this patent is extended or adjusted under 35 U.S.C. 154(b) by 0 days.

(21) Appl. No.: 10/776,349

(22) Filed: Feb. 12, 2004

(65) Prior Publication Data

US 2004/0194769 A1 Oct. 7, 2004

(30) Foreign Application Priority Data

Feb. 14, 2003 (JP) ..... P.2003-036666

(51) Int. Cl.[7] ..... F02P 3/02
(52) U.S. Cl. ..... 123/621; 315/257
(58) Field of Search ..... 123/620, 621, 123/640, 643; 315/213, 257

(56) References Cited

U.S. PATENT DOCUMENTS 3,035,108 A * 5/1962 Kaehni ..... 123/637
4,557,229 A * 12/1985 Kashima et al. ..... 123/169 EL
4,653,460 A * 3/1987 Ooyabu et al. ..... 123/645
5,156,136 A * 10/1992 Okumura ..... 123/621
6,035,838 A * 3/2000 Tozzi et al. ..... 123/618

FOREIGN PATENT DOCUMENTS

JP 6-33857 2/1994
JP 2001-234842 8/2001

* cited by examiner

*Primary Examiner*—Mahmoud Gimie
(74) *Attorney, Agent, or Firm*—McGinn & Gibb, PLLC

(57) ABSTRACT

There is provided an ignition coil alleviating an insulating load between output terminals and at inside of the ignition coil and stabilizing insulating performance by constituting two outputs from the ignition coil by the same output electrode. Specifically, the invention is characterized in arranging two ignition plugs at a single cylinder, providing a center tap terminal at a secondary coil, regularly winding the secondary coil until reaching the center tap terminal and inversely winding the secondary coil from a regular winding direction to an inverse winding direction after reaching the center tap.

8 Claims, 7 Drawing Sheets

IGNITION APPARATUS FOR INTERNAL COMBUSTION ENGINE

BACKGROUND OF THE INVENTION

The present invention relates to an ignition apparatus for an internal combustion engine, particularly relates to a winding structure of a coil.

In recent years there is proposed an ignition apparatus provided with a plurality of ignition plugs for each cylinder for firmly igniting a mixture gas having a low fuel rate to realize low fuel cost. In the case of a 4 cylinder engine, each of cylinders #1 through #4 is provided with ignition energy twice as much as that in the case of one piece of an ignition coil by feeding electricity from respective 2 pieces of ignition coils and therefore, the mixture gas can firmly be ignited and combusted.

There is an ignition system which is proposed in a prior art and disclosed in JP-A-6-33857. FIG. 10 shows an outlook view thereof. As is apparent from FIG. 10, for example, a 4 cylinder internal combustion engine is provided with 4 pieces of ignition coils 10, 20, 30, 40, and respective cylinders #1 and #4 as well as #2 and #3 utilize group ignition in which respective 2 pieces of cylinders are brought into a relationship of strokes of the internal combustion engine opposed to each other. Taking an example of the ignition coils 10 and 40, a first output terminal constituting an electrode having + polarity is connected to an ignition plug provided at #1 cylinder and a second output terminal constituting an electrode of − polarity having inverse polarity is connected to an ignition plug provided at #4 cylinder via a high voltage cord. Further, similar connections are also constituted in the ignition coil 20 and the ignition plug 30 related to #2 and #3 cylinders.

According to the above-described respective ignition coils 10 through 40, high voltages induced at secondary windings by cutting to conduct electricity to primary windings are applied to the ignition plugs from the output terminals having + polarity and − polarity, that is, both ends of the secondary windings such that polarities inverted to each other are constituted for the respective cylinders. Thereby, the high voltages generated from the first and second output terminals of the respective ignition coils are consumed as ignition energy only in the ignition plugs on sides of cylinders disposed in an explosion stroke. Whereas in an exhaust stroke which is brought into a relationship of being opposed to a compression stroke immediately before the explosion stroke, pressure in the cylinder is low and therefore, a discharge voltage of the ignition plug is about 1 kV, the pressure in the cylinder disposed in the explosion stroke immediately after the compression stroke is high, the discharge voltage becomes about several 10 kV and almost all of electric power is consumed.

FIG. 11 shows an ignition apparatus disclosed in JP-A-2001-234842 as a further advanced ignition system. As is apparent from FIG. 11, there is proposed an ignition apparatus of a structure in which a + electrode side and a − electrode side of an ignition coil provided at each of cylinders are respectively directly connected to a + polarity ignition plug and a − polarity ignition plug of the same cylinder. FIG. 12 shows a constitution view of the secondary coil of such an ignition coil. The secondary coil is constructed by a constitution of starting to wind a secondary copper wire 82, around a secondary bobbin 80 from a secondary terminal 84*a* to finish to wind to a secondary terminal 84*b*.

[Patent Reference 1]
JP-A-6-33857
[Patent Reference 2]
JP-A-2001-234842

However, according to the above-described ignition apparatus, the ignition energy is transmitted via the high voltage cord and therefore, there poses a problem of producing energy loss at the high voltage cord and taking cost in the high voltage cord per se.

According to a system of abolishing the high voltage cord and directly connecting the secondary coil of the ignition coil to the same cylinder, outputs of the both electrodes are constituted by the + polarity for carrying out + discharge and the − polarity for carrying out − discharge and therefore, in the case of supplying a voltage required for igniting the engine, when, for example, each of the both electrodes needs a voltage of 30 kV, a potential difference of 60 kV is produced between the output terminals, and insulation breakdown is brought about between the two output terminal portions caused by the potential difference to thereby cause a failure in the ignition apparatus.

Further, since the + polarity and the − polarity are generated in the output of the ignition coil, the electrode of the − potential which is easier to consume than the electrode of the positive potential by being impacted by positive ions produced by the discharge, differs in the two ignition plugs, and there poses a problem that a center electrode is selectively consumed in the first ignition plug and an outer electrode is selectively consumed in the second ignition plug.

Further, although it is generally said that in discharge of the ignition plug, − discharge is more excellent than + discharge in an energy efficiency, according to the ignition apparatus having the above-described constitution, + discharge and − discharge are utilized and an improvement therein is also desired. It is an object of the invention to provide an ignition apparatus resolving the problem, capable for preventing insulation breakdown and at the same time, capable of outputting a voltage component for only − polarity or + polarity of a high voltage output having an excellent energy efficiency and provided from a secondary coil.

SUMMARY OF THE INVENTION

In order to resolve the above-described problem, as an outline constitution of the invention, there is provided an ignition coil alleviating an insulating load between output terminals and inside of an ignition coil by constituting two outputs from the ignition coil as the same output electrode and stabilizing insulating performance. Further, when wear preventing tips constituted by platinum tips or the like of a discharge gap portion of an ignition plug are adopted for two electrodes of the discharge gap by constituting the same output by the two electrodes, only one side thereof may be constituted and an inexpensive ignition system can be provided.

Specifically, according to Aspect 1, there is provided an ignition apparatus characterized in an ignition apparatus arranged with two ignition plugs at a single cylinder, the ignition plug being applied with a high voltage from the ignition apparatus and including an iron core, a primary coil constituted by winding a primary copper wire around the iron core, and a secondary coil constituted by winding a secondary copper wire around an outer periphery thereof constituting a magnetic circuit in which the primary coil and the secondary coil are contained in a case and thereafter sealed by an insulating member, wherein the secondary coil is wound around a secondary bobbin, the secondary bobbin is provided with a center tap terminal, the secondary coil is regularly wound until reaching the center tap terminal and is wound there around from a regular winding direction to an inverse winding direction after reaching the center tap.

According to Aspect 2, there is provided an ignition apparatus characterized in an ignition apparatus arranged with two ignition plugs at a single cylinder, the ignition plug being applied with a high voltage from the ignition apparatus directly attached onto an engine head cover for directly applying the high voltage and including an iron core, a primary coil constituted by winding a primary copper wire around the iron core and a secondary coil constituted by winding a secondary copper wire around an outer periphery thereof constituting a magnetic circuit in which the primary coil and the secondary coil are contained in a case and thereafter sealed by an insulating member, wherein the secondary coil is wound around a secondary bobbin, the secondary bobbin is provided with a center tap element at a center thereof, the secondary coil is regularly wound until reaching the center tap terminal and wound there around from a regular winding direction to an inverse winding direction after reaching the center tap, and the center tap terminal is connected to the ground or a + electrode of a battery.

Further, in the above-described constitution, an ON time voltage preventing diode may be arranged between the center tap terminal and the ground or the + electrode of the battery. Further, a regularly winding coil and an inversely winding coil may separately be formed by providing two of the center tap terminals and the ON time voltage preventing diodes may be arranged between the respective center tap terminals and the ground or the + electrode of the battery. Further, the secondary bobbin may be constituted by two individual secondary bobbins of a secondary regular winding bobbin for winding regularly and an inversely winding secondary bobbin for winding inversely, and the ON time voltage preventing diodes maybe arranged between terminals of the individual secondary bobbins and the ground or the + electrode of the battery.

DETAILED DESCRIPTION OF THE PREFERRED EMBODIMENTS

Figure 4:
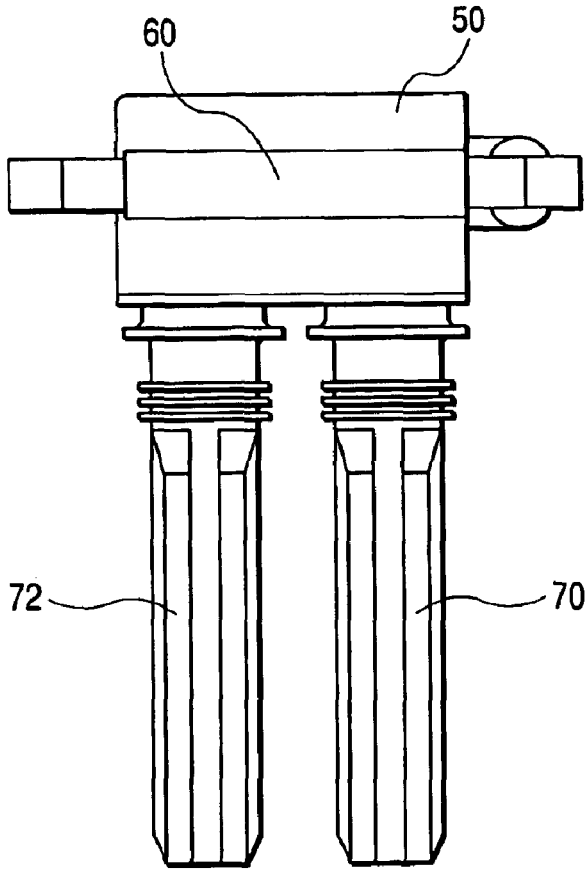
FIG. 4 shows an outer shape view of the ignition apparatus of the invention.

A description will be given of an embodiment of the invention as follows. A basic constitution of an ignition apparatus of the invention is provided with an iron core and a primary coil constituted by winding a primary copper wire around a primary bobbin at an outer periphery of the iron core, provided with a secondary coil constituted by winding a secondary copper wire around a secondary bobbin at an outer periphery of the primary coil, provided with a case for containing the iron core and the respective coils, in which the case contains a primary terminal supplied with a power source from a battery and a switching ignitor portion of a power transistor or the like for carrying out ignition control depending on cases and molded with a potting resin or the like for insulating and fixing inside thereof, further, provided with a secondary output portion as a high voltage output of the ignition apparatus. The secondary output portion is connected to an ignition plug arranged at an internal combustion engine and a high voltage of about 30 KV provided from the ignition apparatus constituted as described above is applied to the ignition plug to thereby realize ignition of the internal combustion engine. An outer shape view thereof is as shown by FIG. 4, primary and secondary coils and a portion of an iron core 60 are embedded in a case 50 and high voltage is supplied to ignition plugs via protectors 70 and 72. According to the ignition apparatus shown in FIG. 4, there is constituted an ignition apparatus in which 2 pieces of the ignition plugs are provided at a single cylinder and ignited simultaneously.

Figure 1:
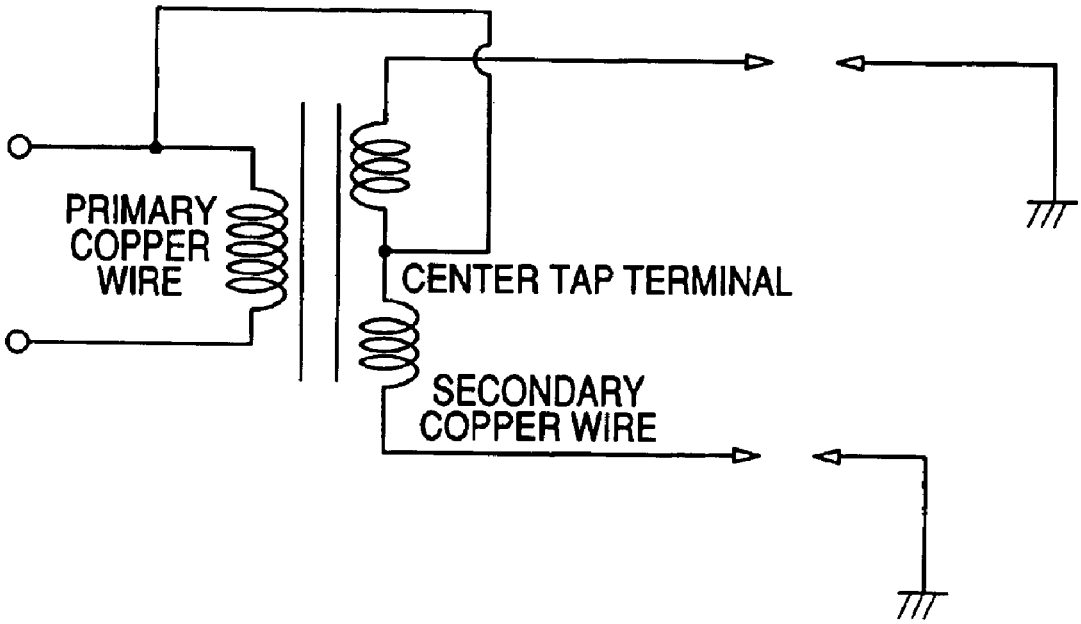
FIG. 1 is a wiring diagram of an ignition apparatus constituting a first embodiment of the invention.

According to the ignition apparatus having the above-described basic constitution, a characteristic of the ignition apparatus of the invention mainly resides in the secondary coil. That is, a first embodiment of the invention is constructed by a circuit constitution shown in FIG. 1. Generally, the secondary coil wound around the secondary bobbin is provided with a wire diameter of 0.05 mm and wound by about 25000 turns. According to the first embodiment, as a direction of winding the secondary coil, 12500 turns constituting a half of all turn number of 25000 turns are wound in the clockwise direction, that is, in a regular winding direction and remaining 12500 turns are wound in the counterclockwise direction, that is, in an inverse winding direction. Further, a portion of the coil shifting from regular winding to inverse winding is connected to + electrode of battery, and both ends of the secondary coil are respectively provided with individual high voltage output terminals and the high voltages are supplied to the individual ignition plugs.

Figure 2:
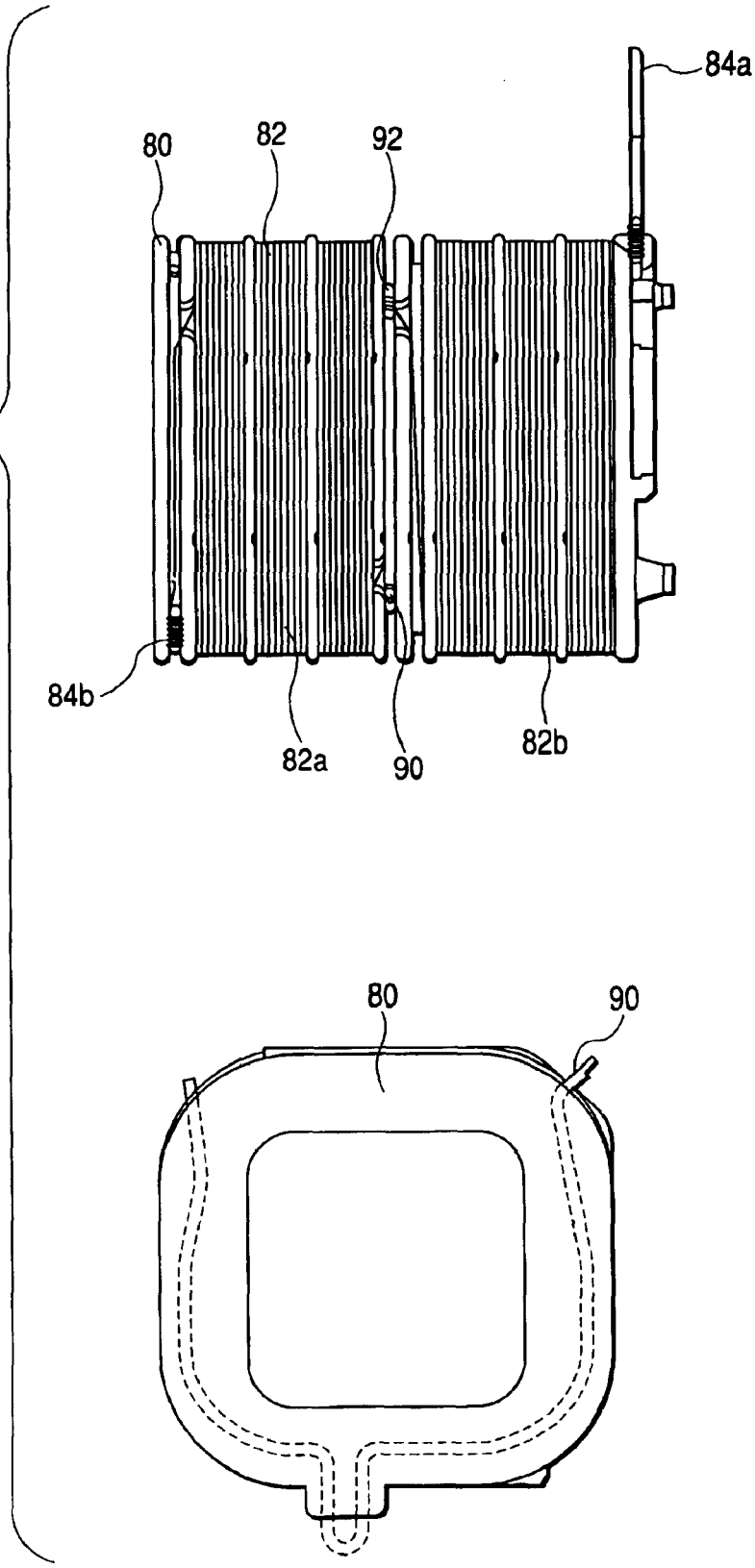
FIG. 2 is a constitution view of a secondary coil constituting the first embodiment of the invention.

According to the ignition apparatus of the first embodiment, the secondary bobbin is provided with a center tap terminal. Further, the secondary coil is, wound in the regular winding direction between one end of the secondary bobbin to the center tap terminal, after finished with the winding operation, the secondary coil is wound in the inverse winding direction between the center tap and other end of the secondary bobbin. FIG. 2 shows a constitution view of the above-described secondary coil. In FIG. 2, the secondary bobbin 80 is wound with the secondary copper wire 82. The secondary bobbin 80 is provided with a regular winding coil 82*a* for winding the secondary copper wire 82 in the clockwise direction and an inverse winding coil 82*b* for winding the secondary copper wire 82 in the counterclockwise direction inverse thereto, and at a boundary portion of the regular winding coil 82*a* and the inverse winding coil 82*b*, a single center tap terminal 90 is provided.

Figure 3:
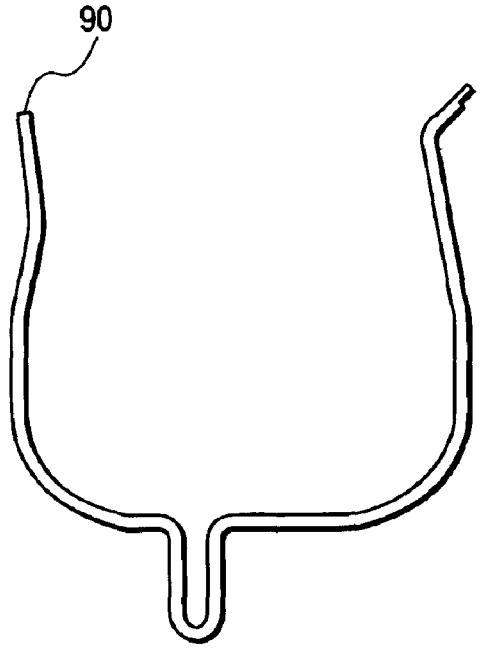
FIG. 3 is a constitution view showing a center tap terminal of the invention.

As a structure of the center tap terminal 90, as shown by FIG. 3, a piano wire is formed to be along a sectional shape of the secondary bobbin and one end portion thereof is made to constitute a terminal portion connected to the + electrode of the battery as a center tap terminal portion 92.

By the above-described constitution, only a voltage component having − polarity or + polarity can be outputted as the high voltage output provided from the secondary coil and the − or + polarity can arbitrarily be outputted depending on a direction of winding the primary coil.

Figure 12:
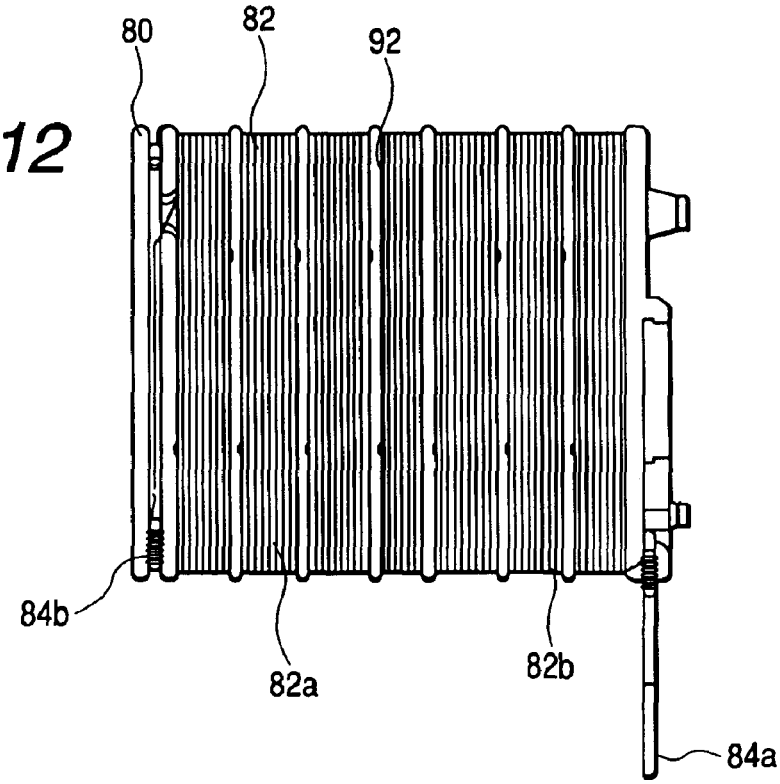
FIG. 12 is a constitution view of a secondary coil of the prior art.

Specifically, a winding start of the primary coil is connected to a side of a primary coil electricity conducting circuit, not illustrated, and a winding end thereof is connected to + electrode of the battery. Here, a direction of winding the primary coil from the winding start to the winding end is defined as regular winding and winding thereof in an inverse direction is defined as inverse winding. By setting connection and direction of winding of the primary coil as described above, according to the invention, there is constructed a constitution for providing a single polarity as the secondary output. Such a secondary bobbin of the first embodiment can inexpensively be fabricated by reforming the secondary coil of the prior art as sown by FIG. 12. Specifically, in a fabrication die, not illustrated, of the secondary bobbin 80 of FIG. 2, by only remaking a slide die of a vicinity of the center tap terminal 90 at center and a portion of wiring to the inverse winding coil 82*b*, other portions of the die can be used commonly with a die of the secondary coil of the prior art as shown by FIG. 12. By constituting in this way, the secondary bobbin can be fabricated by a small number of parts and inexpensively.

Figure 5:
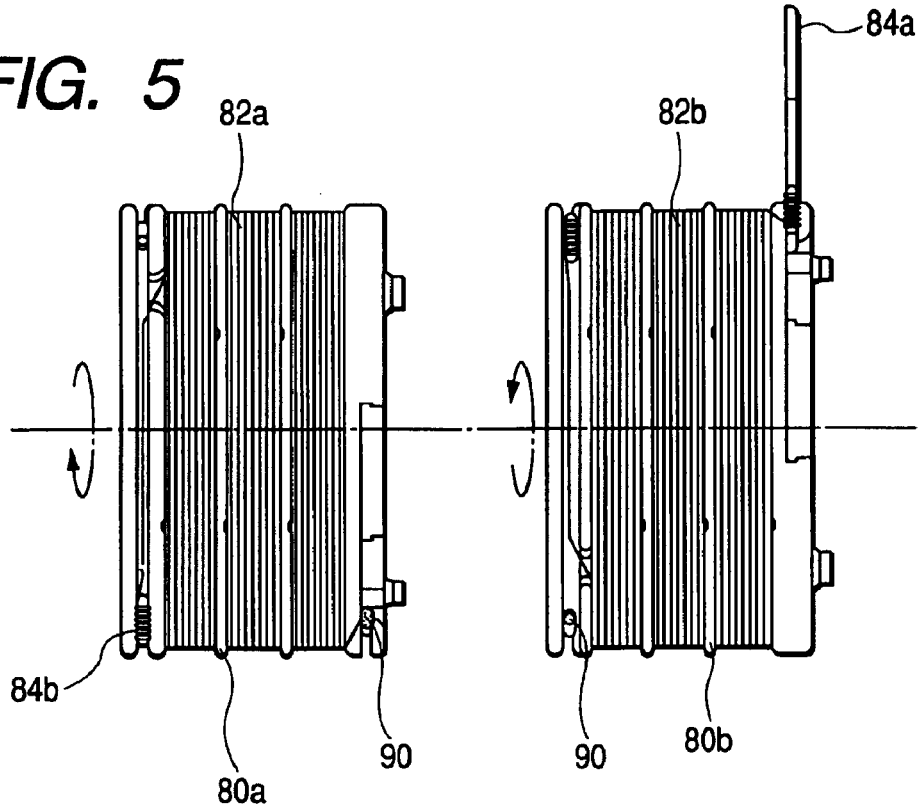
FIG. 5 is a wiring diagram of an ignition apparatus constituting a second embodiment of the invention.

Further, FIG. 5 shows a second embodiment of the invention. In FIG. 5 in the first embodiment, a diode for preventing ON time voltage is arranged between the center tap terminal and + electrode of the battery. The diode for preventing ON time voltage is arranged such that an anode thereof is connected to the side of the center tap terminal. The other constitution stays the same as or corresponds to that of the first embodiment and therefore, an explanation thereof will be omitted.

Next, a description will be given of a constitution of a third embodiment of the invention.

Figure 6:
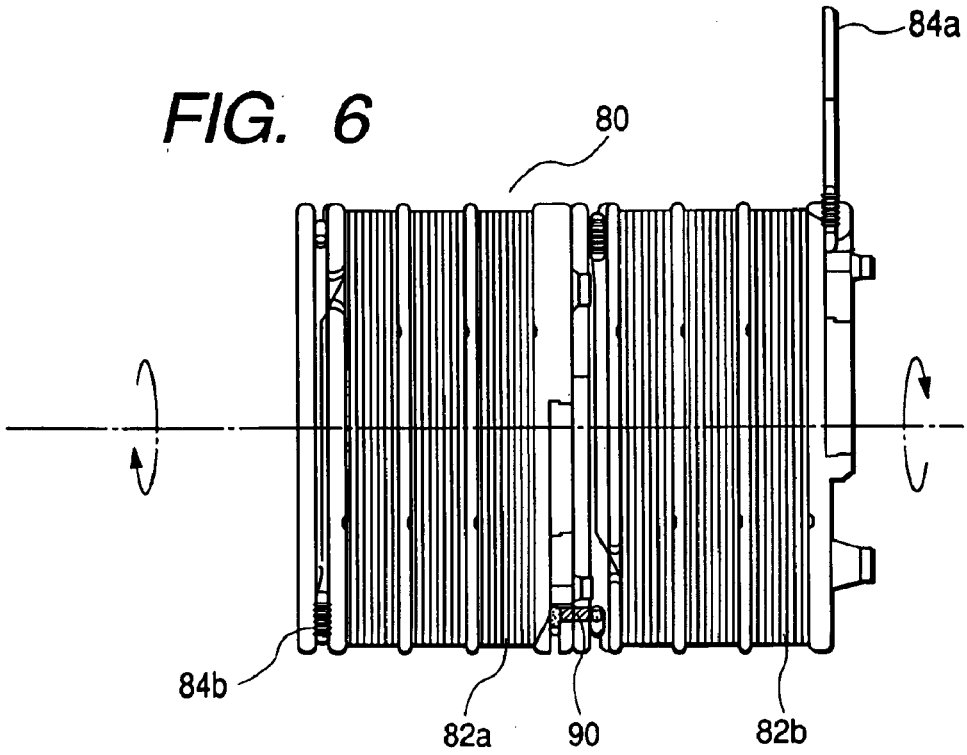
FIG. 6 is a wiring diagram of an ignition apparatus constituting a third embodiment of the invention.

According to the third embodiment, the center tap terminals of the respective secondary coils are constituted to connect to + electrode of the battery. The diode is arranged such that a cathode thereof is connected to the side of the ignition plug as shown by FIG. 6.

Figure 7:
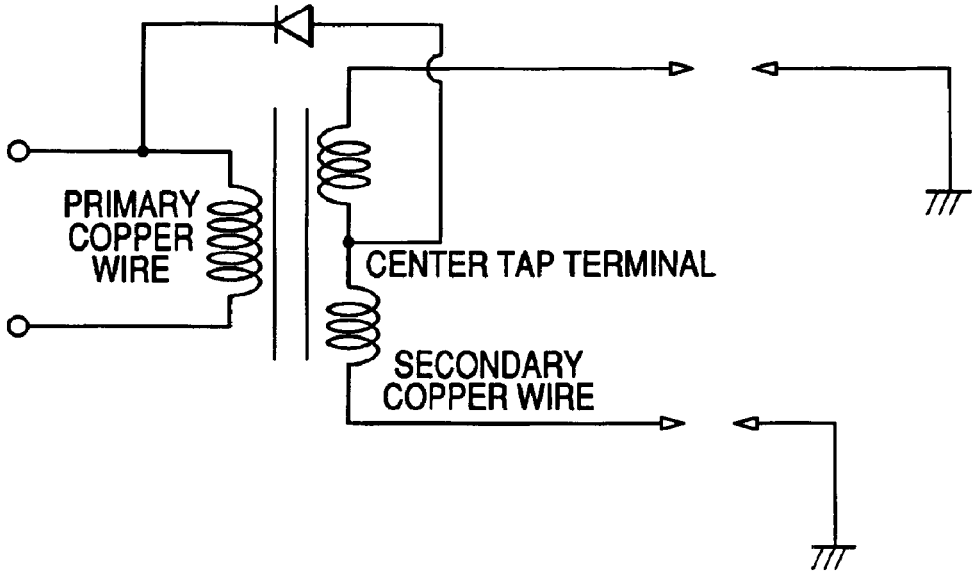
FIG. 7 is a constitution view before integrating a secondary coil showing a modified example of the first, the second and the third embodiments of the invention.
Figure 8:
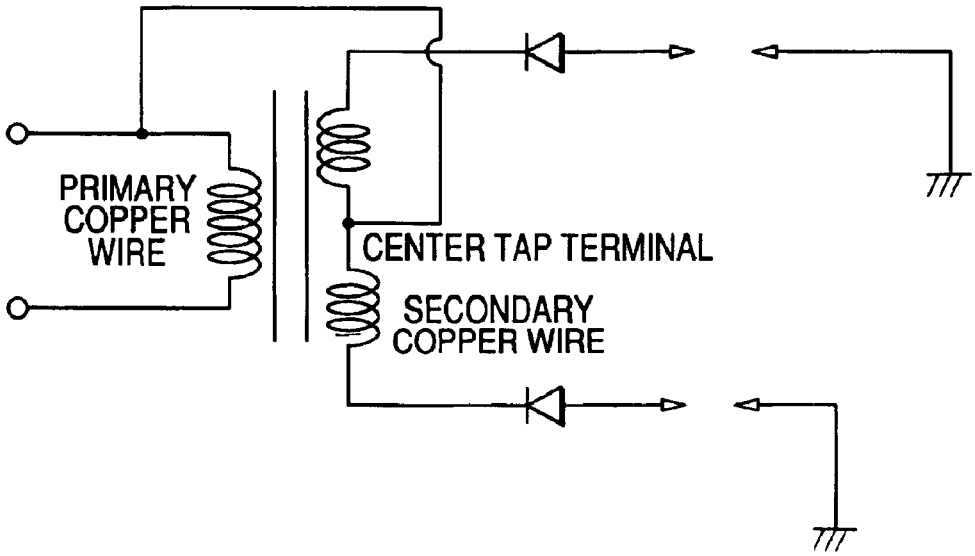
FIG. 8 is a view of finishing the secondary coil of FIG. 7.

The secondary coil explained in the first, second and third embodiments may be constituted as a modified example as follows. That is, a main body of the secondary bobbin may be constituted by individual bobbins, two bobbins of one secondary coil wound only regularly and other secondary coil wound only inversely may be constituted and the single secondary bobbin may be constituted by integrating the two bobbins by connecting terminals thereof or soldering. That is, two secondary bobbins of a secondary bobbin 80*a* for regular winding and a secondary bobbin 80*b* for inverse winding are provided, there is formed the regular winding coil 82*a* for winding the secondary copper wire in the clockwise direction from the secondary terminal 84*b* which is a winding start terminal of the secondary bobbin 80*a* for regular winding to the center tap terminal 90 which serves also as a winding end terminal, and there is formed the inversely wound coil 82*a* for winding the secondary copper wire in the counterclockwise direction from the center tap terminal 90 which also serves as a winding start terminal of the secondary bobbin 80*b* for inverse winding to the secondary terminal 84*a* which is a winding end terminal. Next, the single secondary bobbin arranged at the outer periphery of the iron core 60 is constituted by electrically connecting the two coils 82*a*, 82*b* by connecting terminals thereof or soldering or the like. By adopting the individual secondary bobbins in this way, a step of winding the secondary coil can be simplified. Explaining by showing views of the structures in FIG. 7 and FIG. 8, in FIG. 7, the regular winding coil 82*a* and the inverse winding coil 82*b* explained in reference to FIG. 2 are respectively wound around bobbins independent from each other, after finishing the winding operation, by integrating the two bobbins, the secondary coil as sown by FIG. 8 is provided and an effect similar to that of the first embodiment is achieved. In this case, the operation of winding the wire around respective bobbins can be carried out by winding the wire only in a single direction and therefore, the fabricating step can be simplified. Further, also in the modified example of the first, the second and the third embodiments, the diode for preventing ON time voltage can be added and in the modified example, the diode for preventing ON time voltage may be provided at a position and in a direction explained in the second embodiment or the third embodiment.

Figure 9:
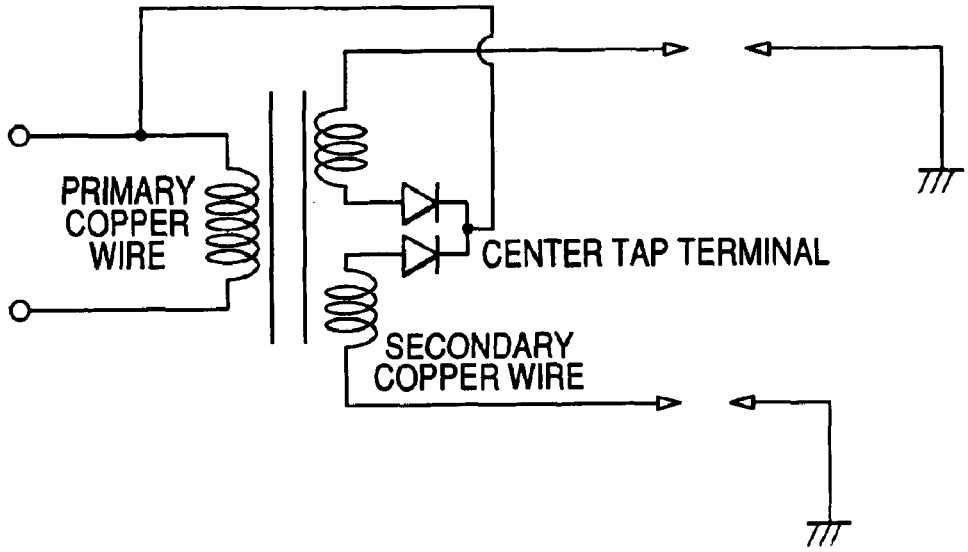
FIG. 9 is a wiring diagram of an ignition apparatus constituting a fourth embodiment of the invention.
Figure 10:
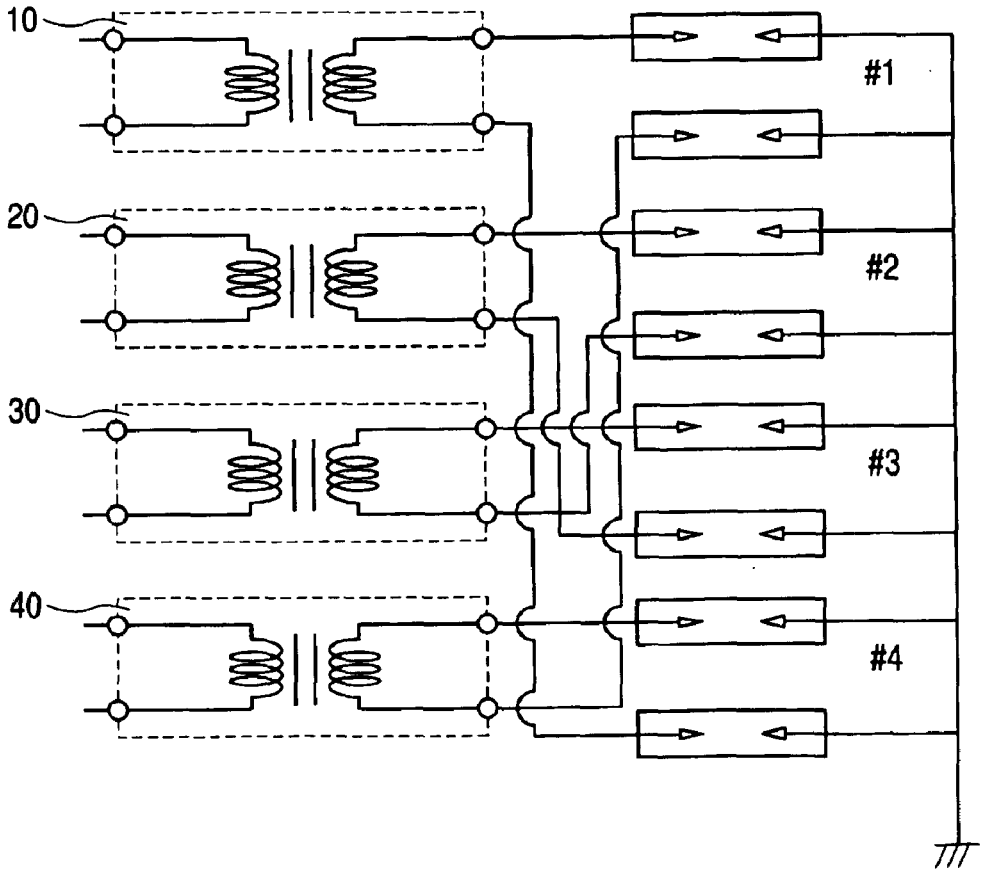
FIG. 10 is a wiring diagram of an ignition apparatus of a prior art.
Figure 11:
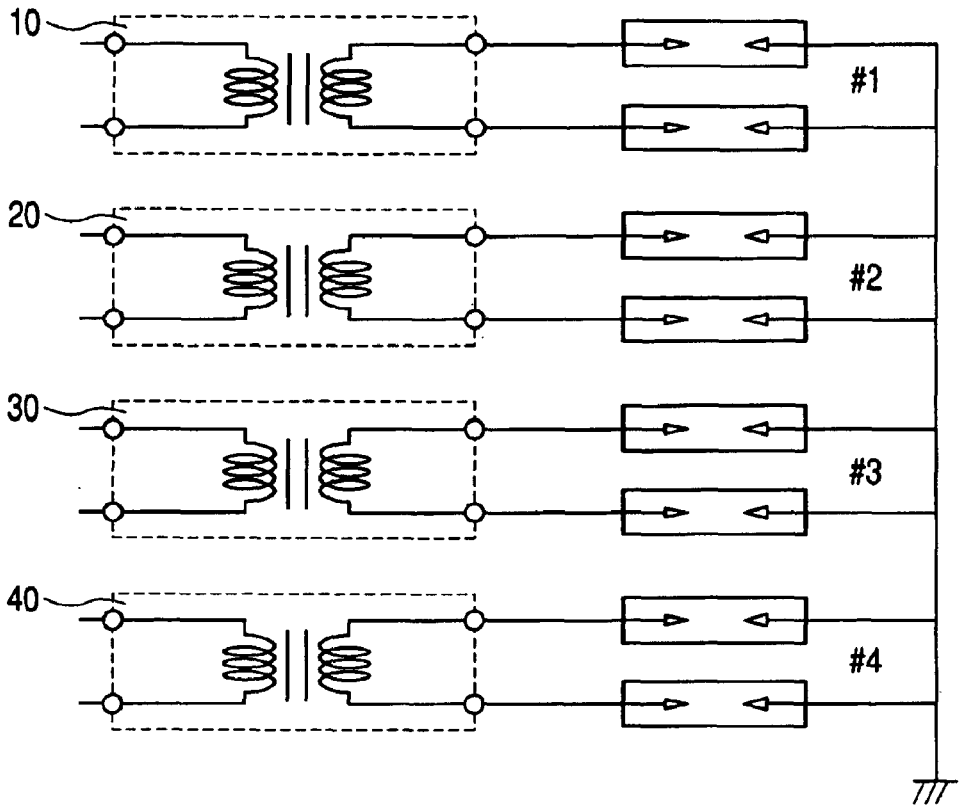
FIG. 11 is a wiring diagram of other ignition apparatus of a prior art.

Further, a constitution may be constructed as follows based on the above-described modified example of the secondary coil as a fourth embodiment. That is, as shown by FIG. 9, there is constructed a constitution of individually arranging diodes for preventing ON time voltage between center tap terminals of the individual secondary coils of the modified example of the first, the second and the third embodiments and + electrode of the battery. That is, in the individual coils 82*a*, 82*b* shown in FIG. 7, mentioned above, after fabricating the individual coils 82*a*, 82*b* by the respective winding steps, the individual coils 82*a*, 82*b* are arranged at the outer periphery of the single iron core 60, the diode for preventing ON time voltage is provided between the center tap terminal 90 which also serves as the winding end terminal of the coil 82*a* and + electrode battery, further, the diode for preventing ON time voltage is provided between the center tap terminal 90 which also serves as the winding start terminal of the coil 82*b* and + electrode of the battery. Naturally, the diodes are arranged to connect anodes thereof to the side of the center tap terminals.

Although in the above-described constitution, a destination of connecting the center tap terminal is constituted by + electrode of the battery, similar operation is achieved by connecting the destination to the grounding side. According to the above-described ignition apparatus having two outputs, a high voltage cable can be abolished by supplying energy to two ignition plugs provided at one cylinder. That is, by the constitution of the first embodiment, only energy of − characteristic can be generated by one ignition apparatus, the high voltage can be outputted simultaneously to 2 pieces of the ignition plugs in one cylinder and therefore, the ignition energy can stably be supplied and ignition operation can firmly be carried out, the discharge polarity stays the same and therefore, insulation breakdown by the potential difference can be restrained. Further, the value of the output voltage, the wire diameter of the second coil and the turn number and the like in the respective embodiments are varied by required performance and are not limited to the above-described. Further, although in consideration of the energy characteristic, the turn number in regular winding and the turn number after inverse winding are desired to be equal, when it is difficult to make the turn numbers equal to each other by a fabricating condition, a difference between the two turn numbers is determined in a range of common sense of design. That is, although the output voltage of the ignition coil is substantially determined by the output voltage of the primary coil and a ratio of the turn numbers of the first coil to the secondary coil, a dispersion in the output voltage of about 10% is generally allowed.

Besides, an ignition apparatus according to the present invention is not restricted to the above-mentioned embodiments.

Needless to say, it is possible to use thereof in the whole engine which needs the ignition apparatus, and it is also possible to properly scale up or down thereof in size according to use application.

By the above-described constitution, the energy is provided from the ignition apparatus only by – discharge, the insulation breakdown between the output terminals which is brought about in the prior art owing to the large potential difference can be restrained and the ignition coil having stable insulation performance can be provided. According to the invention, by halving the potential difference in the prior art technology, the load of the ignition apparatus per se can be restrained and the ignition apparatus having excellent quality can be provided. Further, since the discharge energy is generated only by – discharge, also the ignition energy efficiency is promoted.

Further, when tips for preventing wear of discharge gap portions of the ignition plugs formed by platinum tips or the like are adopted for both electrodes of the discharge gaps by making high voltage output characteristics equal to each other, only one side thereof may be provided therewith and the inexpensive ignition system can be provided.

What is claimed is:

1. An ignition apparatus comprising:

two ignition plugs at a single cylinder, the ignition plug being applied with a high voltage from the ignition apparatus, an iron core constituting a magnetic circuit, a primary coil constituted by winding a primary copper wire around the iron core, and a secondary coil constituted by winding a secondary copper wire around an outer periphery thereof, the primary coil and the secondary coil being contained in a case and thereafter sealed by an insulating member, wherein the secondary coil is wound around a secondary bobbin, the secondary bobbin includes a center tap terminal, and the secondary coil is regularly wound until reaching the center tap terminal, and is wound therearound from a regular winding direction to an inverse winding direction after reaching the center tap.

2. An ignition apparatus comprising:

two ignition plugs at a single cylinder, the ignition plug being applied with a high voltage from the ignition apparatus directly attached onto an engine head cover for directly applying the high voltage, an iron core constituting a magnetic circuit, a primary coil constituted by winding a primary copper wire around the iron core, and a secondary coil constituted by winding a secondary copper wire around an outer periphery thereof, the primary coil and the secondary coil being contained in a case and thereafter sealed by an insulating member, wherein the secondary coil is wound around a secondary bobbin, the secondary bobbin includes a center tap terminal at a center thereof, the secondary coil is regularly wound until reaching the center tap terminal, and is wound therearound from a regular winding direction to an inverse winding direction after reaching the center tap, and the center tap terminal is connected to the ground or a + electrode of a battery.

3. The ignition apparatus according to claim 1, further comprising:

an ON time voltage preventing diode arranged between the center tap terminal and the ground or the + electrode of the battery.

4. The ignition apparatus according to claim 1, further comprising:

a regularly winding secondary coil and an inversely winding secondary coil individually provided, and the ON time voltage preventing diodes arranged between the respective center tap terminals and the ground or the + electrode of the battery.

5. The ignition apparatus according to claim 1, further comprising:

the ON time voltage preventing diodes arranged between terminals of the secondary bobbins and the ground or the + electrode of the battery.

6. The ignition apparatus according to claim 2, further comprising:

an ON time voltage preventing diode arranged between the center tap terminal and the ground or the + electrode of the battery.

7. The ignition apparatus according to claim 2, further comprising:

a regularly winding secondary coil and an inversely winding secondary coil individually provided, and the ON time voltage preventing diodes arranged between the respective center tap terminals and the ground or the + electrode of the battery.

8. The ignition apparatus according to claim 2, further comprising:

the ON time voltage preventing diodes arranged between terminals of the secondary bobbins and the ground or the + electrode of the battery.

* * * * *